US005271313A

United States Patent [19]

Lindegren, III

[11] Patent Number: 5,271,313

[45] Date of Patent: Dec. 21, 1993

[54] POSITION-CONTROLLED ACTUATOR

[76] Inventor: Carl J. Lindegren, III, 16 Tattan Farm Rd., Worcester, Mass. 01605

[21] Appl. No.: 792,210

[22] Filed: Nov. 12, 1991

[51] Int. Cl.[5] ..... F15B 13/16; F15B 13/04

[52] U.S. Cl. ..... 91/358 R; 91/403; 91/410; 92/242

[58] Field of Search ..... 91/358 R, 358 A, 361, 91/363 R, 364, 392, 403, 410; 92/242, 243, 444

[56] References Cited

U.S. PATENT DOCUMENTS

| | | | |
|---|---|---|---|
| 2,314,398 | 3/1943 | Hoch | 91/403 |
| 3,667,723 | 6/1972 | Schneider | 91/392 |
| 3,953,213 | 4/1976 | Gasper | 92/244 X |
| 3,972,264 | 8/1976 | Field | 91/358 A |
| 4,281,590 | 8/1981 | Weaver | 92/244 |
| 5,065,665 | 11/1991 | Kimura | 91/403 X |

FOREIGN PATENT DOCUMENTS

| | | | |
|---|---|---|---|
| 267280 | 7/1970 | U.S.S.R. | 91/392 |
| 0591627 | 1/1978 | U.S.S.R. | 91/392 |

*Primary Examiner*—Edward K. Look
*Assistant Examiner*—Hoang Nguyen
*Attorney, Agent, or Firm*—Blodgett & Blodgett

[57] ABSTRACT

A position-controlled actuator including a double acting pneumatic actuator, a selector valve which causes function of the actuator, a comparator which controls the action of the selector valve in response to a comparison between an input signal and a signal indicative of the position of the actuator, and a feedback link which provides the comparator with a signal indicative of the position of the actuator. The actuator would have oscillation damping seals such as seals of VITON brand fluorocarbon rubber.

6 Claims, 15 Drawing Sheets

POSITION-CONTROLLED ACTUATOR

BACKGROUND OF THE INVENTION

There are many circumstances in industrial control and processing in which it is necessary to control linear movement or rotary movement at selectable points on the range between two end points. The traditional approach to this very important operation was typically divided into two functions. The first function involved the physical actuator which would apply force to the element to be moved and to thereby accomplish the actual physical movement from one point on the range of movement to another point. The second function was a controller function typically involving a feed-back loop. Typically, the controller would monitor a signal indicating the position of the element to be moved and that signal would be fed back to a remote control device. The control device would typically be remotely located because it is frequently the case that the actuator and element to be actually moved are in a reasonably hostile environment, frequently not appropriate for the kind of delicate controllers often employed in sophisticated process control. The design of the controller frequently involved relatively complex analysis because of the sometimes complex relationship between the signal indicative of the position of the element to be moved and the actions of the actuator in accomplishing that movement. This complexity in controller design frequently adds very greatly to the cost of developing an appropriate actuator-controller pair for a specific application.

Furthermore, the traditional approach to these movement control problems frequently involve process signal time delays which can result in unstable process control functions and various types of destructive oscillation. This is particularly true of the pneumatic control methods which are preferred in the almost universal circumstances where explosive atmosphere or high environmental moisture argue against electric control.

Finally, there are numerous process control situations where the actuator and any associated equipment must be located in difficult to reach environments frequently involving relatively hostile conditions. Furthermore, many process operations are running constantly, and, therefore, any down-time attributable to maintenance of control actuators or associated equipment is frequently unacceptable. Furthermore, the design criteria for many process situations require reliability of equipment for very long periods of time, imposing further difficulties on what might otherwise be relatively delicate and maintenance-prone devices.

These and other difficulties experienced with prior art devices have been obviated in a novel manner by the present invention. It is, therefore, an outstanding object of the present invention to provide an actuator-controller pair which can respond to a process signal in a feed-forward control loop to carry out specific physical movement along a range between two end points.

Another object of this invention is the provision of an actuator-controller pair which can be constructed from commodity-type equipment in a modular fashion so that the development cost for equipment can be controlled and minimized.

A further object of the present invention is an actuator-controller pair in which the functions are essentially formed into one unit to substantially eliminate control signal time delays between the actuator and the controller thereby reducing various destructive effects of control time delays.

A still further object of the invention is the provision of a controller-actuator pair which, because it is essentially a single unit, can be quickly and easily installed in its appropriate locations with a minimum of hook-up activity and therefore, a minimum activities of which create a very high probability of potential installation-related problems.

It is a further object of the invention to provide an actuator-controller pair which employs a relatively available and fully developed modular controller unit which directly monitors the physical positioning of the actuator to control the actuator.

A still further object of the present invention is the provision of an actuator-controller pair in which problems concerning destructive oscillation and resulting early failure of the equipment have been controlled or eliminated.

With these and other objects in view, as will be apparent to those skilled in the art, the invention resides in the combination of parts set forth in the specification and covered by the claims appended hereto.

SUMMARY OF THE INVENTION

This invention involves a device which controls the physical movement and position of an equipment element over a range between two end points in response to a process signal having a value between two signal end points. The device itself actually has four functional subassemblies. The first subassembly is an actuator, typically of the pneumatic cylindrical actuator type. Special seals are provided to eliminate destructive oscillation of the assembly, which has been found to occur when conventional seals are used. More specifically, conventional seals, formed of the polymer "Buna-N" are removed and new seals, formed of the polymer viton-brand fluorocarbon rubber, are substituted.

The second subassembly is the selector valve which controls the delivery of energy, preferably, pneumatic energy, to the actuator, to accomplish its movement.

The third subassembly is a comparator which controls the functioning of the selector valve.

The fourth subassembly is a feedback device which monitors the position of a movement element in the actuator and feeds a signal indicative of that position back to the comparator.

The comparator compares the feedback signal to a process control signal and uses that difference to operate the selector valve.

The entire controller-actuator assembly is essentially a unitary physical element bolted together for ease of installation and short control distances in order to minimize control delays. Furthermore, the selector valve and comparator are essentially a single unit which is a commonly available commodity item developed for a different arrangement used to control the rotation of ball and butterfly valves.

BRIEF DESCRIPTION OF THE DRAWINGS

The character of the invention, however, may be best understood by reference to one of its structural forms as illustrated by the accompanying drawings, in which.

DESCRIPTION OF THE PREFERRED EMBODIMENT

Figure 1:
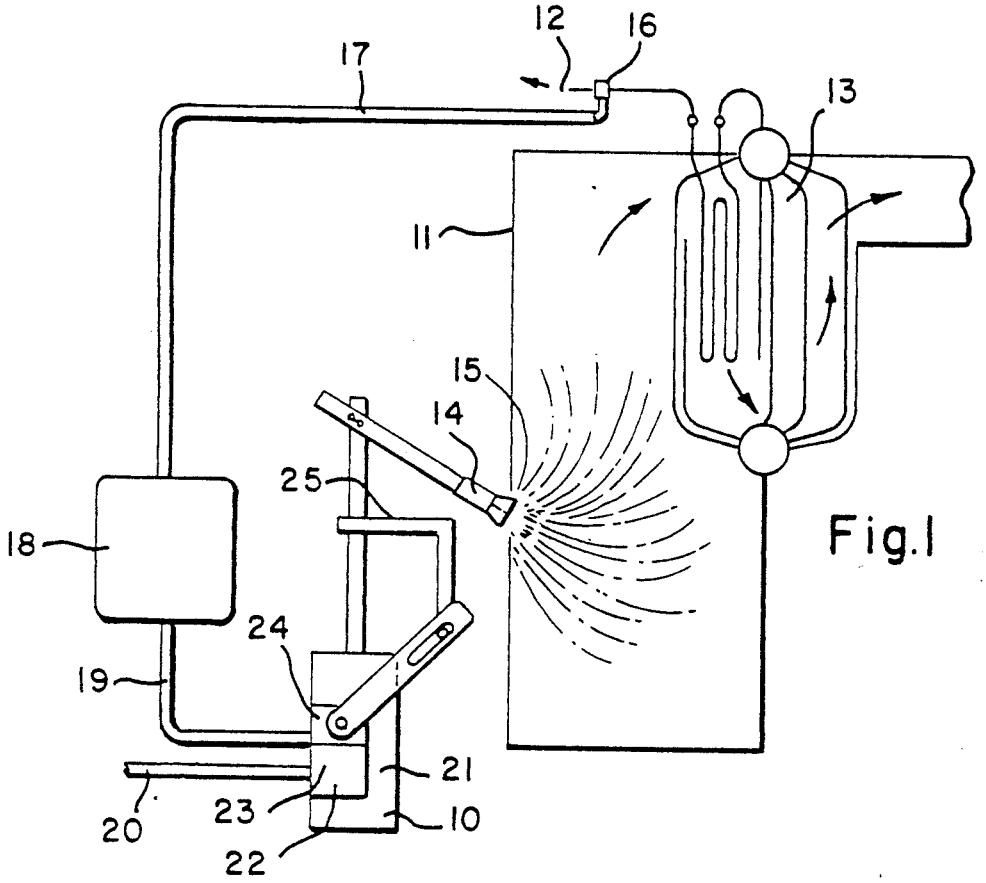
FIG. 1 shows a diagrammatic representation of a typical application of a position-controlled actuator embodying the principles of the present invention.

Referring first to FIG. 1 in which the general principles of the present invention are portrayed in a typical process-control application, the position-controlled actuator of the present invention is designated as numeral 10. FIG. 1 shows a diagrammatic representation of a typical system for controlling the temperature of superheated steam in a utility boiler 11. In this particular boiler design, the temperature of steam exiting from the superheat section, passing out from the steam exit 12 of the superheat section 13, can be modified by tilting a burner 14 about an axis 15. When the inwardly directed exit of the burner 14 is tilted downward, as shown in FIG. 1, the temperature of the steam passing out of the exit is reduced. On the other hand, when the burner is tiled so that the inwardly directed fuel port is pointed up, the temperature of the steam passing out of the exit is raised. By controlling the tilt of the burner, for a specific set of operating conditions for the boiler, the temperature of the superheated steam can be controlled within narrow limits, arm 36 thereby controlling steam pressure and electricity generation.

In a typical control situation for this design of boiler, a temperature sensor 16 would generate a signal indicative of the temperature of the superheated steam passing out of exit 12. The signal would be fed along line 17 to the central controller 18 for the whole boiler. The central controller 18 would send a pneumatic signal along signal line 19 to the position-controlled actuator 10. The position-controlled actuator 10 would control the tilt of the burner 14 in response to the pneumatic signal on the signal line 19. The power for operating the position-controlled actuator would be provided by a pneumatic supply line 20 which would provide air pressure at 100 lbs. per square inch.

The position-controlled actuator includes a pneumatic actuator 21, the controller unit 22 which is made up of the selector valve 23 and the comparator 24, and the feedback link 25.

Figure 4:
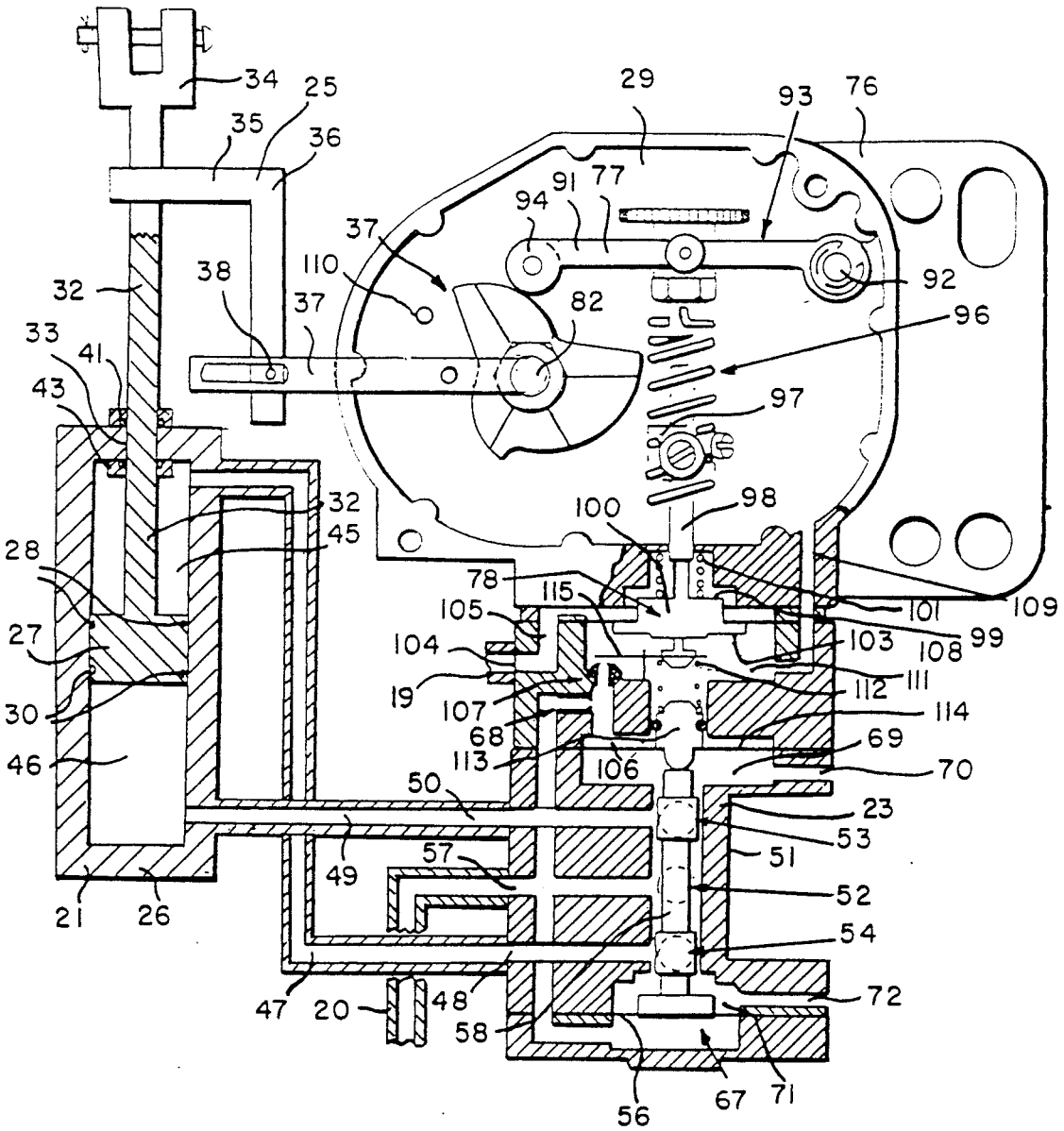
FIG. 4 shows a cross-sectional view of a schematic representation of the position-controlled actuator embodying the principles of the present invention.

FIG. 4 is a cross-sectional view of a diagrammatic representation of the position-controlled actuator embodying the principles of the present invention. The actuator 21 is shown schematically as a pneumatic cylinder. More specifically, it is a cylindrical container 26 in which a piston is slidable mounted. Between the piston and the inner wall of the cylindrical container are piston seals 28 and 30. A piston shaft 32 is connected to the piston and extends through a shaft port 33 to the exterior of the cylindrical container 26. The piston shaft slides out of the shaft port through seals 41 and 43. The outer end of the piston shaft 32 has a connector 34 suitable for connection to a working element of the application equipment.

The feedback link 25 is rigidly connected to the outer point on the piston shaft 32. The feedback link includes a radial arm 35, a longitudinal arm 36 pivotally connected to the radial arm 35, and a crank arm 37 which is pivotally connected to the longitudinal arm 36 and mounted to the rotary cam 80 within the comparator 29.

The longitudinal arm 36 and the crank arm 37 are connected by a slidable joint 38. The piston shaft slides out of the shaft port through seals 41 and 43.

The piston divides the cylindrical container into a front chamber 45 and a rear chamber 46. Pneumatic line 47 connects the front chamber 45 to front port 48 on the selector valve. Pneumatic line 49 connects the rear chamber 46 to the rear port 50 on the selector valve.

The selector valve 23 is made up of a housing 51 and a spool 52, slidably mounted in the housing. The spool carries two seals 53 and 54 along its length. The spool is mounted between a pilot diaphragm assembly 55 and an end cap diaphragm 56.

The housing 51 contains a number of passages and chambers. Front port 48 leads to the vicinity of front seal 54. Rear port 50 leads to the vicinity of rear seal 53. Supply port 57, which is connected to the air supply line 20, leads by passage to the vicinity of the center of the spool 52 between the rear seal 53 and the front seal 54 by supply passage 58. Supply passage 58 also provides air to end cap chamber 67 and to restriction 68. A rear exhaust chamber 69 and rear exhaust port 70 are located adjacent the rear seal end of the spool 52. The front exhaust chamber 71 and front exhaust port 72 are positioned at the front seal end of the spool 52.

The comparator 29 consists of a housing 76 which is integral with the housing 51 of the selector valve, and a position processing subassembly 77, an input diaphragm assembly 78 and a spool positioning subsystem 79. The position processing subassembly 77 includes a cam plate 81 which is mounted for rotation about an axis 82. Its rotation is controlled by the motion of crank arm 37 which is connected, indirectly, to the cam plate 81. The cam plate has a cam surface 83 which has a low point 84 which has a short radial distance to the axis, a high point 85 which has a longer radial distance to the axis, and an intermediate portion 86. The position processing subassembly 77 also includes a cam follower assembly 91. The cam follower assembly includes a pivot point 92 within the housing 76, a cam follower arm 93 pivotally mounted on the pivot point 92, and a cam follower 94 which rides on the cam surface 83. A range spring 96 extends from the mid-portion of the cam follower arm 93 and is connected to a span nut 97, and thereby, to a draw bar 98 which is biased by range spring 96 toward the cam follower arm 93. The draw bar 98 is also connected to the upper signal diaphragm 99 which is biased away from the draw bar 98 by a spring 101.

The signal diaphragm chamber 102 is bounded by the upper signal diaphragm 99 and the lower signal diaphragm 103. The pneumatic signal which instructs the system is fed to the signal diaphragm chamber 102 from signal line 19, through signal input port 104, and passage 105.

The spool positioning subassembly includes a pilot chamber 106 which is fed supply air by restriction 68 and exhausts through nozzle 107. The spool positioning subsystem 78 also includes an exhaust chamber 108 which is fed by nozzle 107 and exhausts through exhaust passage 109 and exhaust port 110.

On the lower side of the lower signal diaphragm 103, which faces the exhaust chamber 108, is a button 111. The button 111 presses through spring 112, upon knob 113, which is slidable in the housing and separates the pilot chamber 106 from the exhaust chamber 108. The knob 113 is fixed to the pilot diaphragm 114 which, itself, contacts the spool 52. The button 111 also acts upon the inner end of a nozzle flapper 115, which is pivotally mounted on a flexure 116. The outer end of the nozzle flapper is positioned above the nozzle 107 so that the distance between the nozzle and the outer end of the nozzle flapper will control the flow rate of air passing through the nozzle. As a result, the physical position of the button 111, acting through the nozzle flapper 115, will control the flow of air through the nozzle 107, and, as a result, the air pressure in the pilot chamber 106 decreases.

Figure 2:
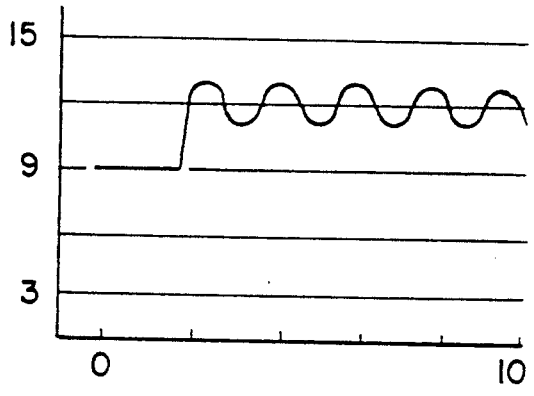
FIG. 2 is a graph showing the oscillation that occurs when conventional seals are used and the control signal is changed from 9 psi to 13 psi.

The operation of the system essentially involves a cooperation of all of the parts described above. Consider a situation where the air pressure on signal line 19 is set at the midpoint between its range of 3–15 p.s.i., that is, at 9 p.s.i. The system would generally take on the appearance which is shown in FIG. 4 with the actuator at its midpoint, that is, the piston 27 would be at approximately the middle of the stroke within the cylindrical container 26. This is shown as time equal zero in FIGS. 2 and 3. Let us assume that the central controller 18, responding to an elevated temperature in the superheater exit 16, noted by sensor 12, determine that the burner 14 should be titled downward about 25%. This would translate into an input signal on signal line 19 of approximately 13 p.s.i. from the previous 9 p.s.i. The input signal of 9 p.s.i., representing a new required valve position, is fed through signal input port 104, passage 105, and into the signal chamber 100 between the upper signal diaphragm 99 and the lower signal diaphragm 103. Since the lower signal diaphragm 103 has a larger effective area than the upper signal diaphragm 99, the increase in the input signal will move the entire signal diaphragm assembly 78 downward. The signal diaphragm assembly 78 operates the nozzle flapper 115 over the nozzle 107 to cause decrease in the pilot air pressure within the pilot chamber 106. This pressure acts upon the top of the pilot diaphragm 114 and biases the pilot diaphragm 114 upward. The pilot air to the nozzle and to the pilot chamber 106 and pilot diaphragm 114 is supplied from the air supply line 20 through restriction 68.

The restriction 68 and nozzle 107 form a pressure divide circuit. An increase in the input signal causes the input diaphragm assembly 78 to move the nozzle flapper outer end upward and away from the nozzle 107. This increases pilot air flow through the nozzle 107 to the pilot exhaust chamber 108 and, as a result, decreases the pilot air pressure in the pilot chamber 106, which pressure acts on the top of the pilot diaphragm 114. The pilot diaphragm 114 and the end cap diaphragm 56 control the position of the spool 52, which, in turn, controls flow of supply air to the actuator 21. The spool 52 operates over the actuator supply ports and simultaneously supplies output to one actuator supply line while exhausting the other actuating supply line during a period when the input signal change occurs.

Ideally, the spool 52 blocks both supply ports when there is no change in signal so that neither supply or exhaust occurs when the positioner is in balance.

In the change situation described above, the decrease in pressure in the pilot chamber 114 allows upward movement of the pilot diaphragm 114 because the pressure in the end cap chamber 67, acting on the end cap diaphragm 56, has not generally been reduced. As a result, the spool is moved upward by the air supply pressure acting on the undersurface of the end cap diaphragm 56 in response to a decrease in the pilot air pressure in the pilot chamber, on top of the pilot diaphragm 114. This movement of the spool 52 connects supply air from the supply air port 57 through passages to the rear port 50, through supply line 49 and to the rear chamber of the actuator 21. At the same time, the front port 48 is connected to the front chamber 45 of the actuator 21 is released. The increased pressure in rear chamber 46 and the decreased pressure in front chamber 45 causes the piston 27 to move upward and causes the connector 34 to move upward toward the new desired position.

The change in the position of the piston shaft 32 causes longitudinal movement of radial arm 35 and longitudinal arm 36 corresponding to the movement of the piston shaft 32. The slidable joint 38 acts upon the crank arm 37 to cause the crank arm 37 to swing about the axis 82. This, in turn, causes cam plate 81 to rotate clockwise and change the position of the cam surface 83 which is presented to the cam follower 94. In this case, the cam follower is lifted upward away from the axis 82, which, in turn, lifts the cam follower arm 93. The cam surface is shaped so that there is an appropriate relationship between the movement of the piston shaft 32 and the position of the cam follower 94 away from the axis 82. The upward movement of the cam follower 94 increases the tension on the range spring 96. The upward force of the range spring 96 causes the input diaphragm assembly 78 to move upward which, in turn, allows the outer end of the nozzle flapper 115 to move downward and to reduce flow of air through the nozzle 107. This increases the pressure within the pilot chamber 106 on top of the pilot diaphragm 114 and, as a result, forces the spool 52 to move downward.

When the connector 34 reaches the position which corresponds to the value of the 13 psi input signal, the upward force of the range spring 96 will equal the downward force of the input signal pressure within signal chamber 100. At this time, the comparator will be in balance and the spool 52 will be positioned so that the spool blocks both the rear port 50 and the front port 48. In that position, neither the front chamber 45 or the rear chamber 46 of the actuator 21 is either being supplied or exhausted. This essentially locks the actuator 21 in its new desired position.

When a reduction in input signal pressure is fed to the system, a process which is essentially the inverse of the above is carried out and the connector 34 will move to its new desired position.

A serious problem has been encountered, however, in attempting to carry out this new combination of relatively well known elements. When this new combination was first attempted, it was discovered that when the system arrived at its new desired position, the system would overshoot, then undershoot, and thereafter oscillate for such a long period of time around the new position that the seals within the actuator 21 would wear out in an unacceptably short period of time, rendering the system impractical.

Essentially, what would happen in actual operation, using conventional equipment, is that the contactor 34 would move from its old position up to and past the new desired position. The system would then respond to the over-shot by pulling the contactor 34 back but, for reasons that are not entirely clear, the effect of the withdrawal would pull the contactor 34 back significantly below the desired position. Once again the controller would recognize the differential between desired and actual position of the contactor 34 and would try to move the contactor back. Once again it would overshoot and this oscillation would continue through hundreds of oscillations, sometimes for hours. In fact, the oscillations continued until the seals in the actuator failed; a clearly unacceptable situation.

Numerous modifications were made in the various elements and variables involved in the combination system, most of which were found not to resolve the oscillation problem. One factor seems to have solved the problem. The normal seal material which would be appropriately employed in double acting pneumatic actuators of the type of actuator 21 and to be used in the environment of these applications would involve typically a polymer known as Buna-N. This material is well known in the industry and in seal practice and would clearly be the appropriate material for this application ordinarily. It has been found, however, that, if these Buna-N seals are replaced by a different material, known in the industry as VITON-brand fluorocarbon rubber, the destructive oscillation ceases to be a serious problem, and in fact, ceases to be a practical problem. The VITON-brand fluorocarbon rubber seals, which are commercially available, would ordinarily be specified where the seals would be exposed to certain solvents or where temperature conditions were very significantly higher than the conditions which would normally be used for the present invention. Except for that temperature factor, the technical specifications for applications with air of the VITON-brand fluorocarbon rubber versus the Buna-N, or other type seal materials, are sufficiently similar that there would not be any reason to expect this very significant improvement in oscillation damping. Therefore, VITON-brand fluorocarbon rubber type seals would not be specified for the conditions of the present invention were it not for the discovery of the oscillation damping effect. It appears that the friction characteristics of the Viton, in the particular dynamic situation of this control invention, so reduce the tendency of the actuator to overshoot the limit on both sides that the oscillation is damped out almost instantly. This situation is shown graphically in FIG. 3. It is assumed that there are other polymers from which seals could be made which would have this special characteristic of the VITON-brand fluorocarbon rubber and those other polymers could be identified by a specific experimental program aimed at identifying, among all of the available polymers, those polymers which exhibit this result.

In the preferred embodiment of this invention, the pneumatic actuator should be equipped with piston and piston rod seals of VITON-brand fluorocarbon rubber to eliminate destructive oscillation. Viton is a Federally registered trademark of E. I. duPont deNemours & Company. Viton-brand fluorocarbon rubber seals are promoted and offered to suit elevated temperature or fluid compatibility requirements when application conditions preclude use of standard materials Viton-brand fluorocarbon rubber is recommended for use with petroleum oils and fluids, selected phosphate ester fluids, halogenated hydrocarbons, or silicone fluids. Viton-brand fluorocarbon rubber is suitable for use at temperatures from −20° F. to +400° F. (−29° C. to +240° C.). This material will withstand intermittent use to +550° F., but is subject to substantial seal life reduction with prolonged exposure to temperatures above +400° F.

Figure 3:
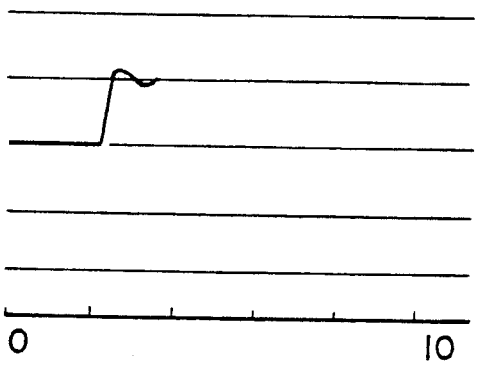
FIG. 3 is a graph showing the damping that occurs when the seals of the present invention are used and the control signal is changed from 9 psi to 13 psi.
Figure 18:
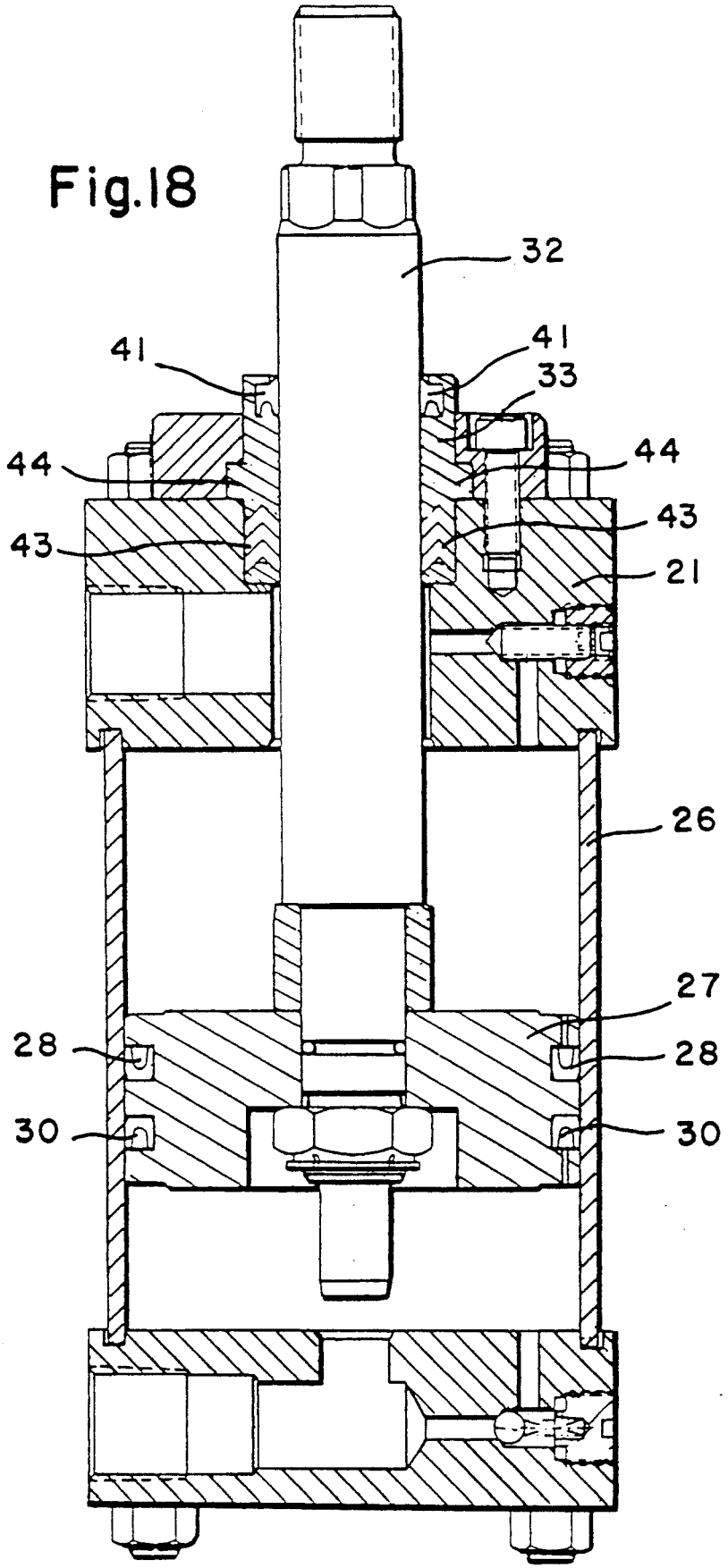
FIG. 18 is a cross-sectional view of an actuator

FIG. 18 shows a cross-sectional view of the type of pneumatic actuator 21 shown in FIG. 3. As described earlier, the actuator consists of a cylindrical container 26, a piston 27 slidable within the container, and a piston rod 32. There are four seals which are of concern in connection with the proper sealing of this device. The piston seals 28 and 30 are low friction, self-compensating cup-type seals designed to provide long, trouble free service. Ordinarily, cylinder sizes through a six inch bore would be provided with piston seals of a silicone-lubricated urethane material. Larger bore sizes would be equipped with seals of Buna-N. In the preferred embodiment of the present invention, as discussed elsewhere, the seals would be formed of VITON-brand fluorocarbon rubber. The piston seals are elastic and snap into the piston grooves for easy installation.

The construction around the periphery of the port 33 where the piston rod 32 exits the cylinder 26 includes rod bearings, removable retainers, rod seals and rod wiper 41. The bushing 44 is precision-machined bronze and maintains concentricity between rod and bore while providing support for the V-ring seal set. The bearing retainer construction allows removal of the seals for maintenance purposes without the rod disassembly.

The rod seals 43 are a pressure-energized, multiple-lip packing set consisting of three V-rings supported by a bronze male adapter which aids seal expansion response to pressure. Seals are self-compensating to adjust for normal wear while providing long-lasting, low-friction service. In the preferred embodiment, these seals would be formed of VITON-brand fluorocarbon rubber.

The rod wiper 41 is a double lipped wiper which cleans the rod surface of contaminants and prevents entry of harmful particles into sensitive bearing and seal areas and is also made from VITON-brand fluorocarbon rubber.

Figure 5:
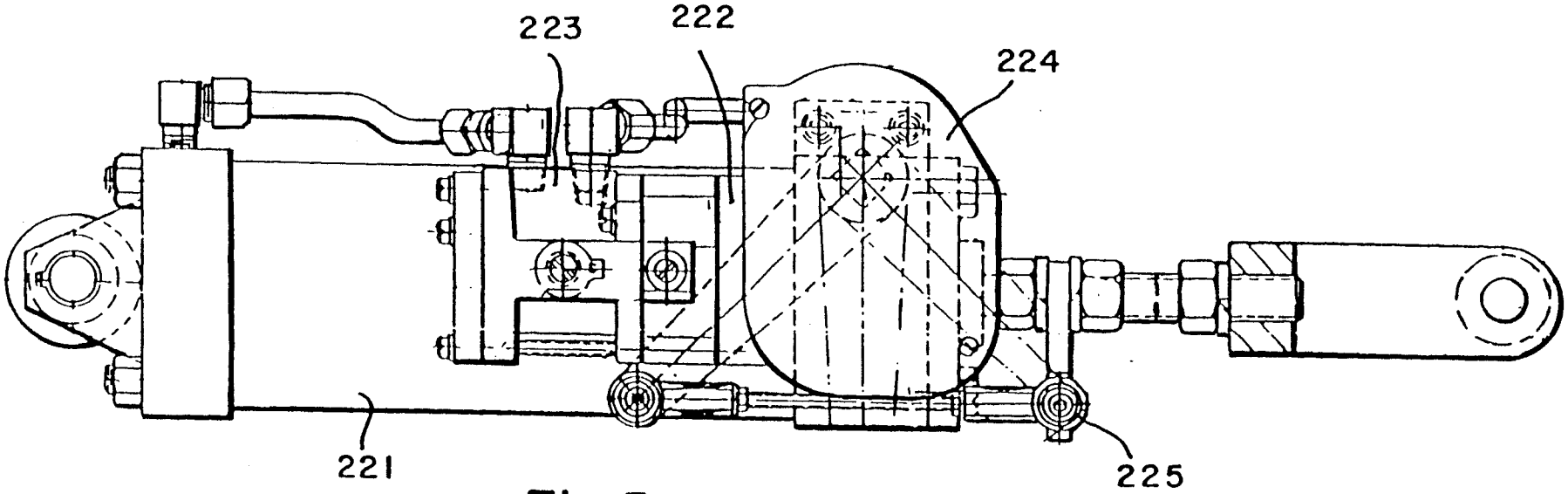
FIG. 5 is a front elevation view of an embodiment of the position-controlled actuator of the present invention.
Figure 6:
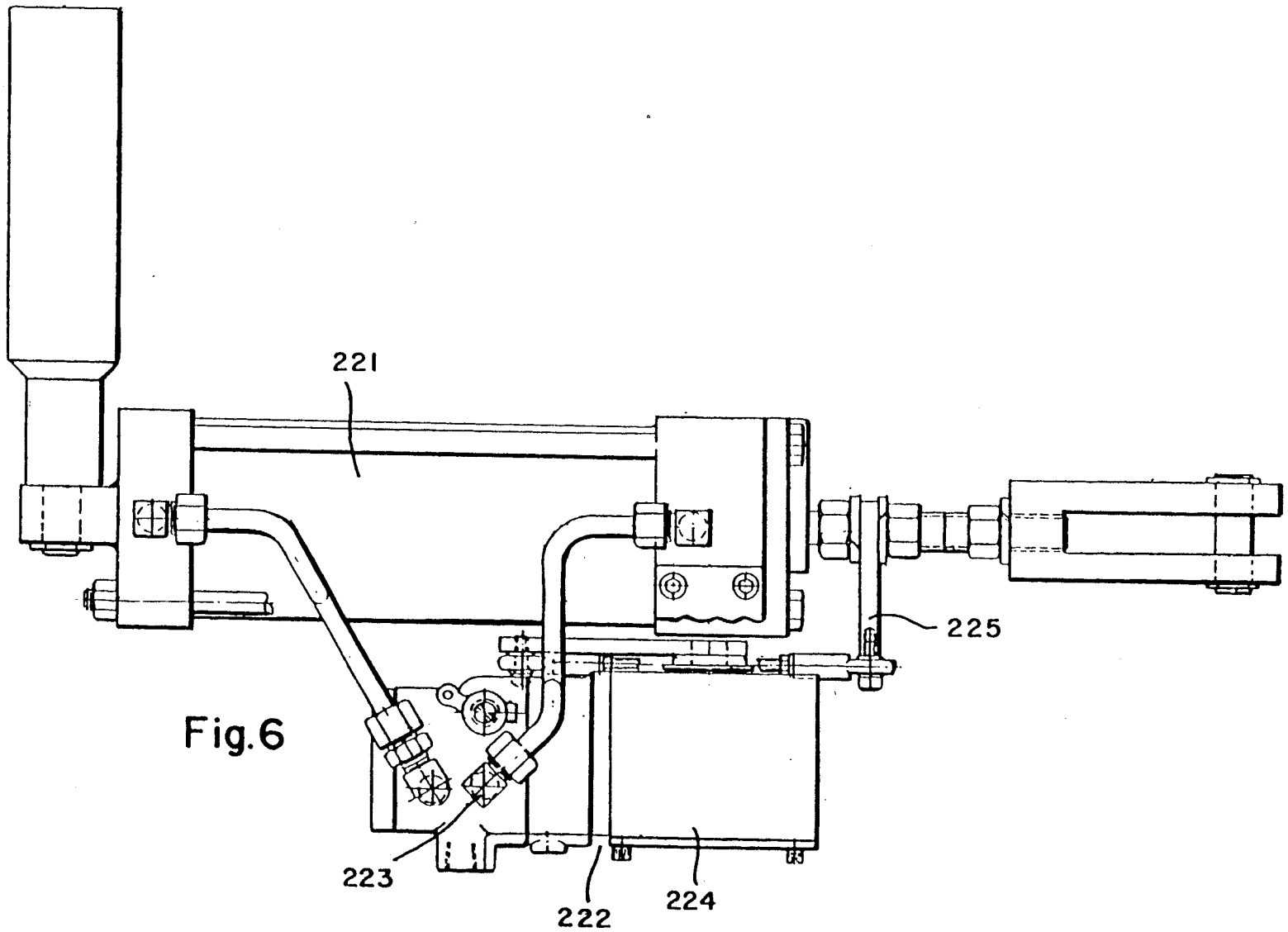
FIG. 6 is a plan view of the embodiment shown in FIG. 5.

While the use of a pneumatic signal to control the present invention is preferred, there are application situations in which an electric signal can be used. Typically, the signal would be in the 4–20 mA range and would be fed to an electro-magnetic actuator within the comparator. The electro-magnetic actuator would impose essentially the same bias on the springs which control the position of the nozzle flapper as would otherwise be imposed by the input diaphragm assembly. Otherwise, the electrically-signalled version of the equipment would function in substantially the same way as the pneumatically signalled version. FIGS. 5–6 show various views of a typical embodiment of the present invention. In this embodiment there is an actuator 221, a controller 222, a selector valve 223, a comparator 224 and a feed forward link 225.

Figure 7:
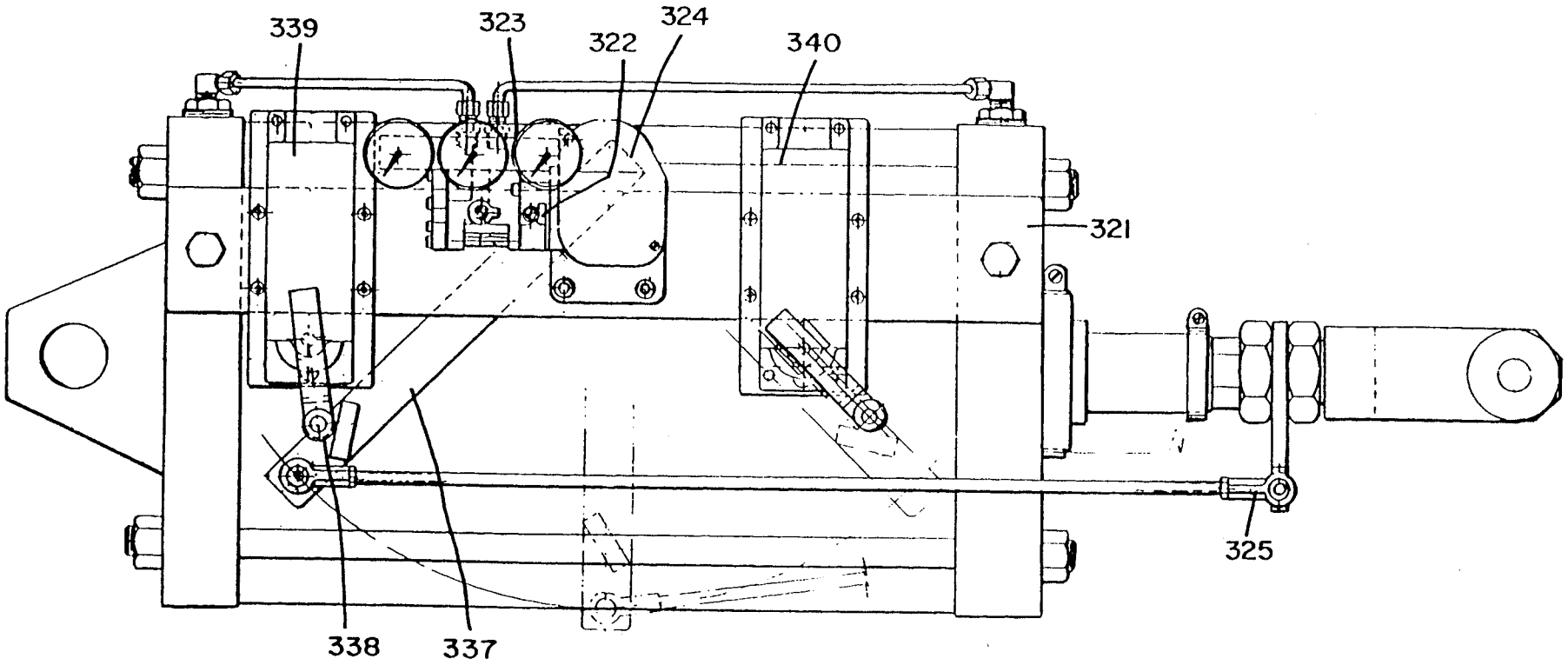
FIG. 7 is a plan view of a second embodiment of a position-controlled actuator embodying the principles of the present invention.
Figure 8:
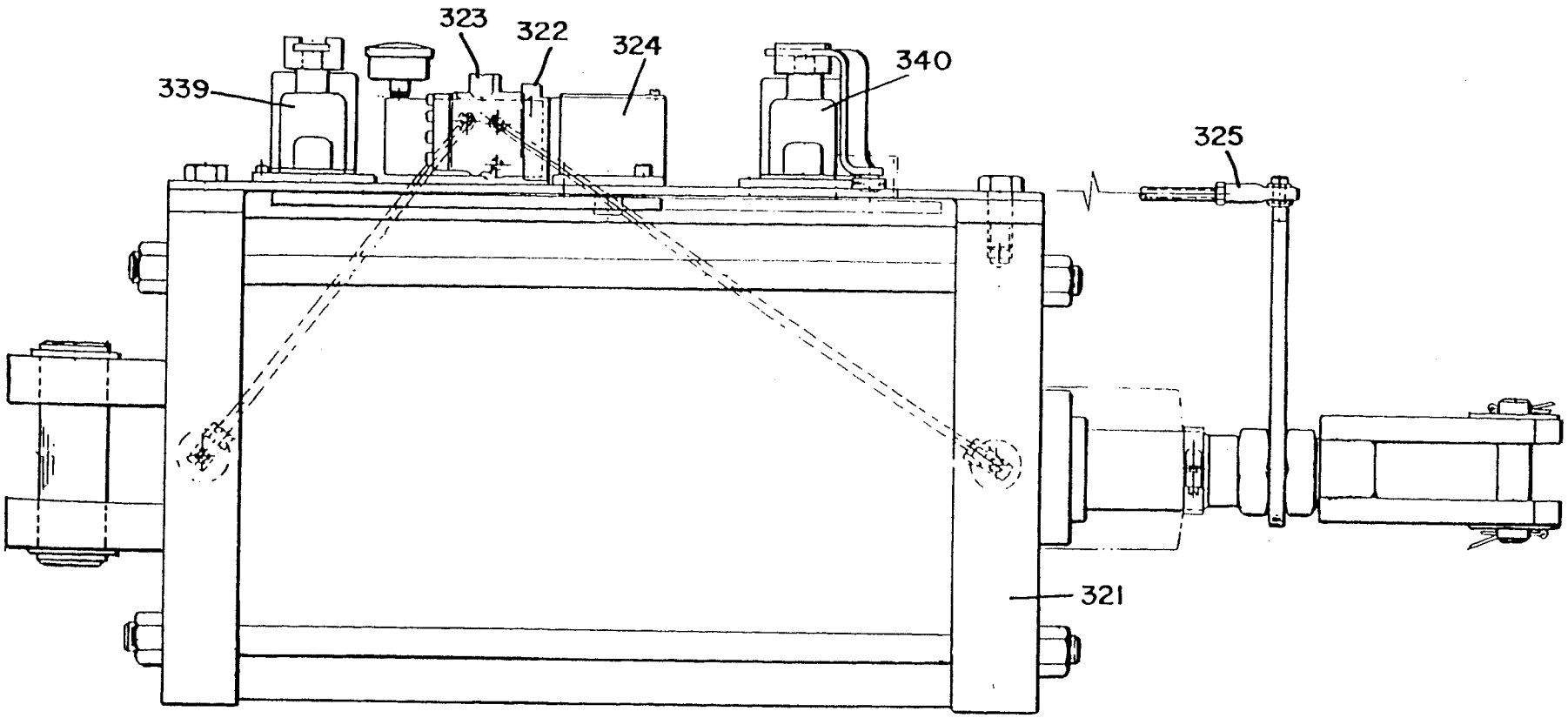
FIG. 8 is a front elevation view of the device shown in FIG. 7.
Figure 9:
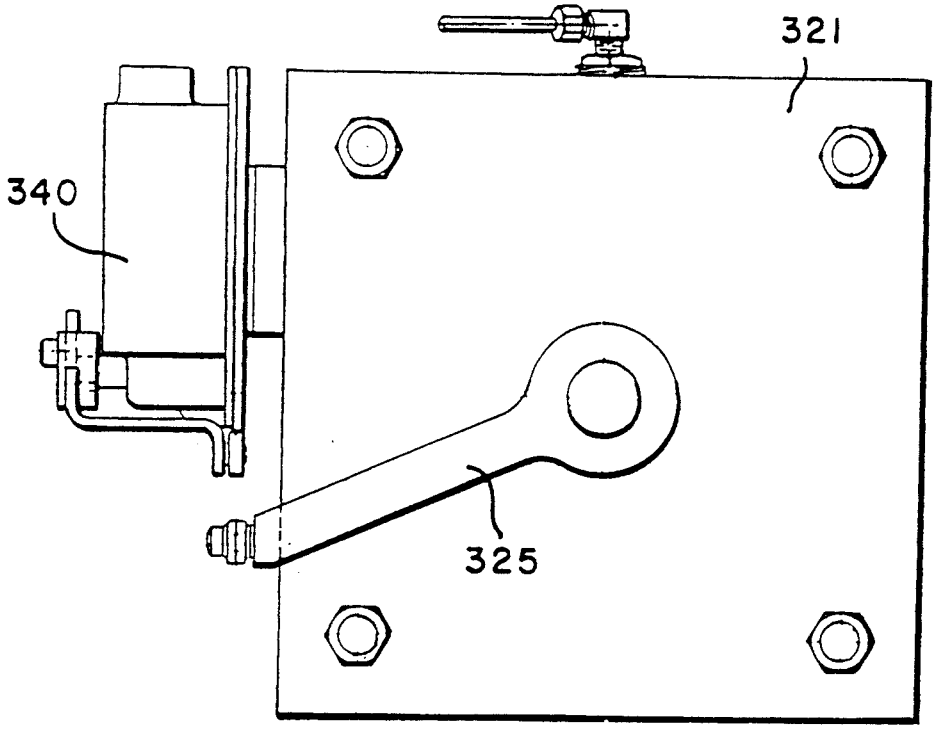
FIG. 9 is a right side view of the device shown in FIG. 7.

FIGS. 7–9 show various views of another typical embodiment of the present invention. In this embodiment there is an actuator 321, a controller 322, a selector valve 323, a comparator 324 and a feedback link 325. In addition, the crank arm 337 carries a contact plate 338 which, at the extremes of its swing, sets off end point sensors 339 and 340 which feed back signals to the main controller of the system indication that the positioner is in one or the other of its extreme positions.

Figure 12:
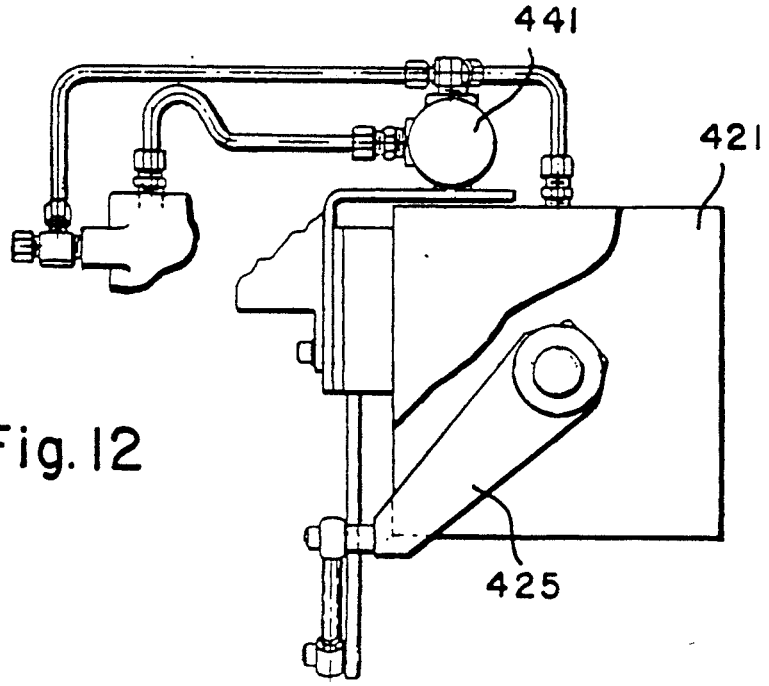
FIG. 12 is a right side view of the device shown in FIG. 10.
Figure 10:
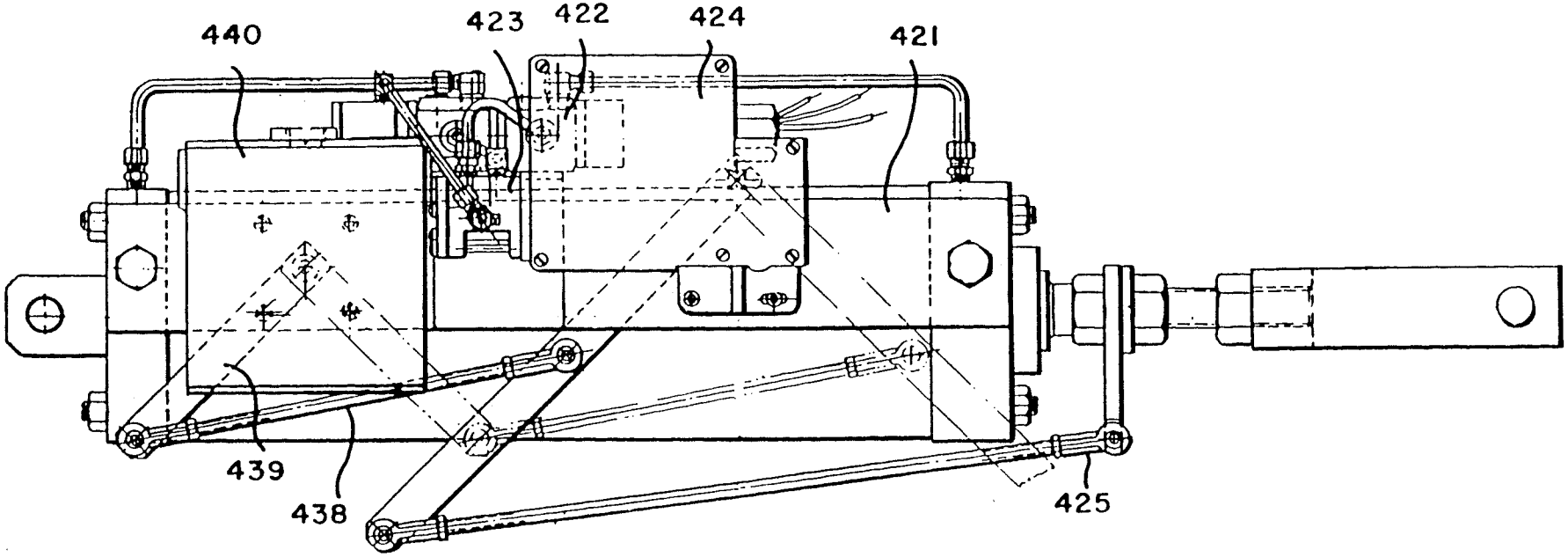
FIG. 10 is a plan view of a third embodiment of a position-controlled actuator embodying the principles of the present invention.
Figure 11:
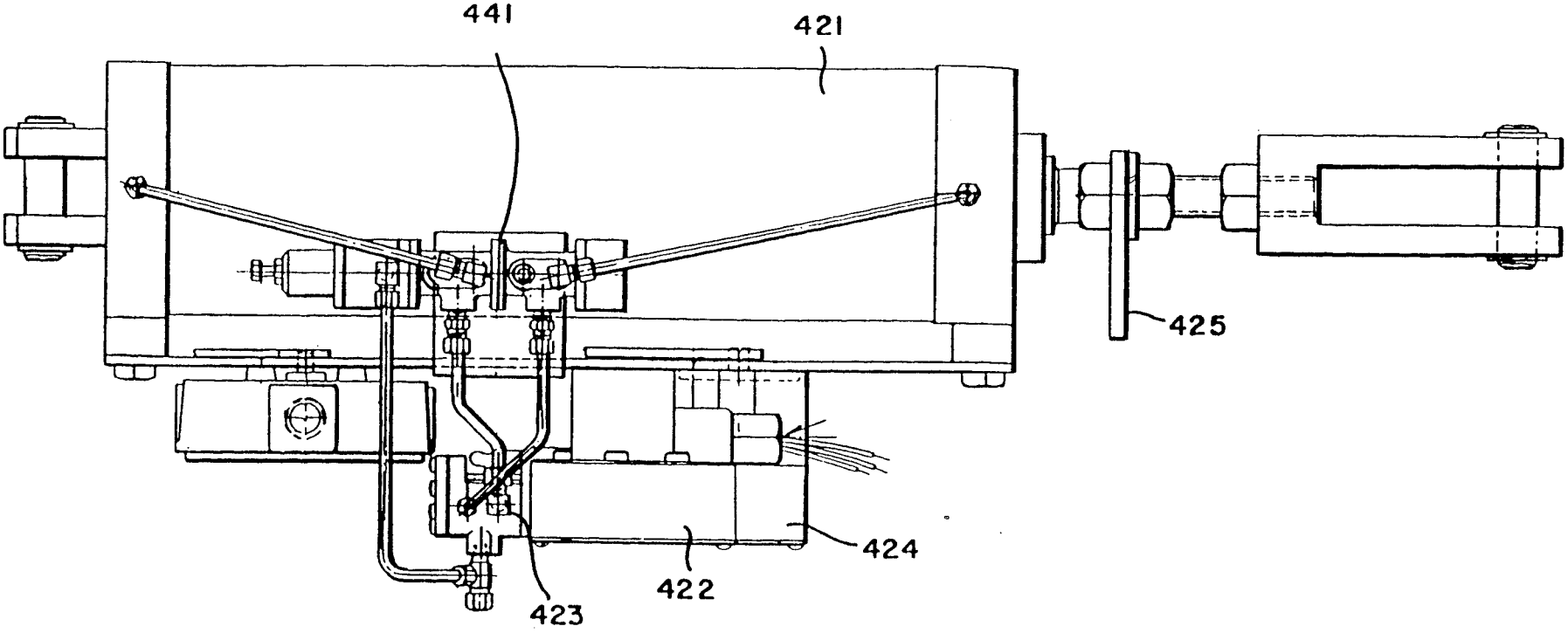
FIG. 11 is a front elevation view of the device shown in FIG. 10.

FIGS. 10–12 show various views of another typical embodiment of the present invention. In this embodiment there is an actuator 421, a controller 422, a selector valve 423, a comparator 424 and a feedback link 425. In this case, the embodiment is set up for an electric control signal so that the comparator 424 is of the electric type. In addition, the crank arm 437 is connected by link 438 and crank 439 to a signal transducer 440 which generates and feeds back a signal to the main controller 18 of the system indicating the precise position that the positioner is located within the range of its movement. This embodiment also includes an emergency actuator lock 441 which locks the actuator against movement if the supply air falls below 60 psi.

Figure 13:
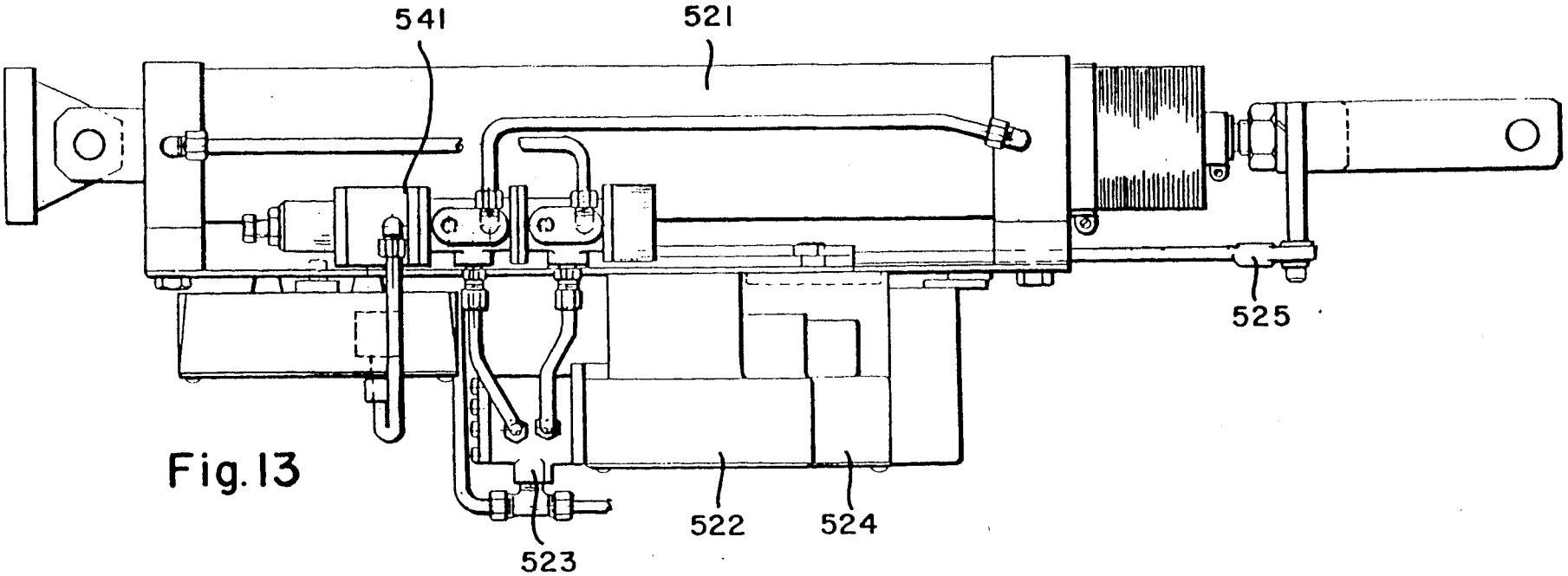
FIG. 13 is a plan view of a fourth position-controlled actuator embodying the principles of the present invention.
Figure 14:
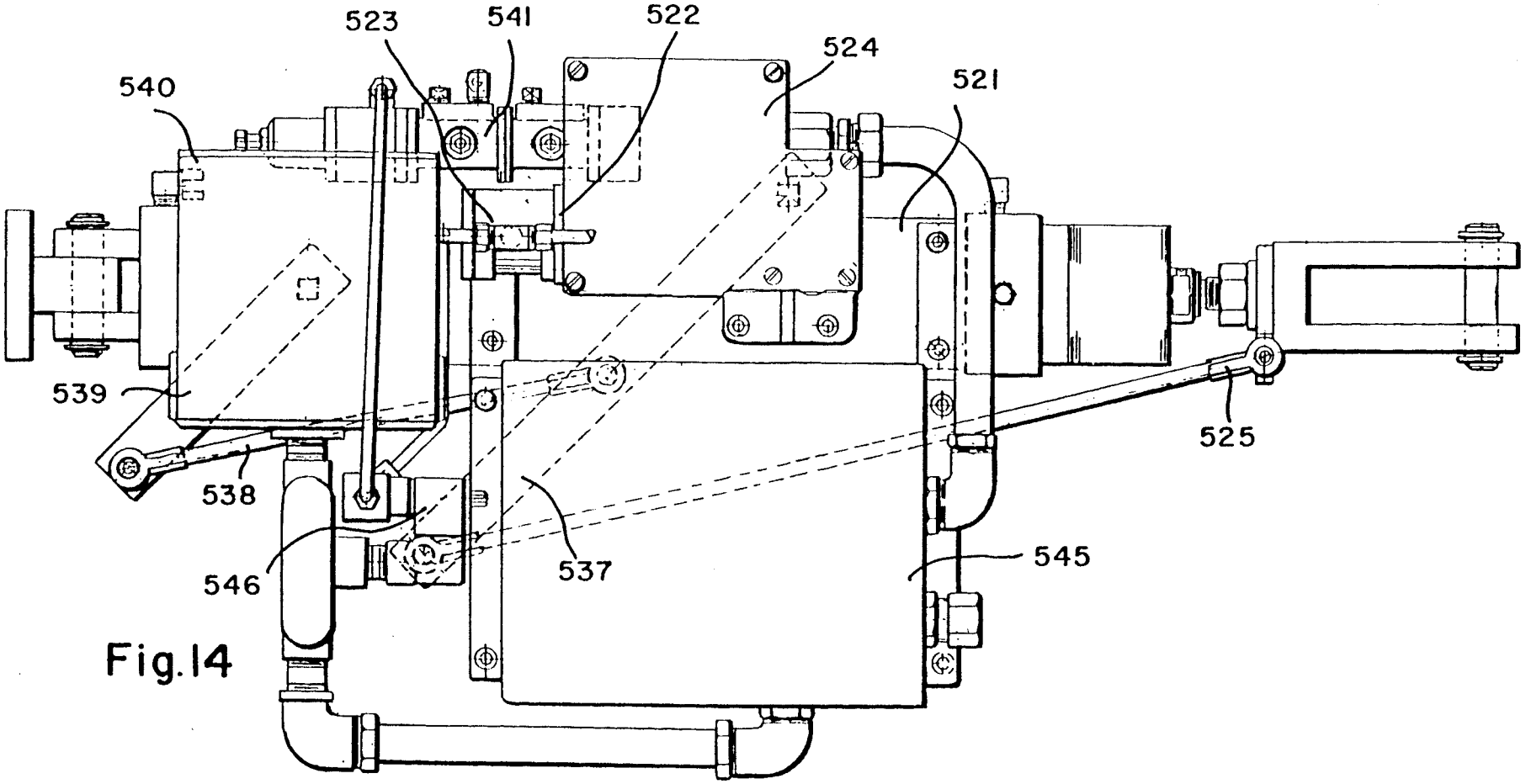
FIG. 14 is a front elevational view of the device shown in FIG. 13.

FIGS. 13–14 show various views of another typical embodiment of the present invention. In this embodiment, there is an actuator 521, a controller 522, a selector valve 523, a comparator 524, and a feed back link 525. In this case, the embodiment is set up for an electric control signal so that the comparator 524 is of the electric type. In addition, the crank arm 537 is connected by link 538 and crank 539 to a signal transducer 540 which generates and feeds back a signal to the main controller 18 of the system indication the precise position that the positioner is located within the range of its movement. This embodiment also includes a dual-function emergency lock 541. In one mode, the lock 541 locks the actuator against movement if the supply air falls below 60 psi. In the other mode, a signal sensor 545 recognizes when the control signal is cut off and, acting through a supply air diverter 546, activates lock 541 to lock the positioner against movement. For example, if the control signal were cut off by accident, the actuator would be locked in its present position rather than being allowed to drop to the low signal position, which could be an undesirable position under the circumstances.

Figure 15:
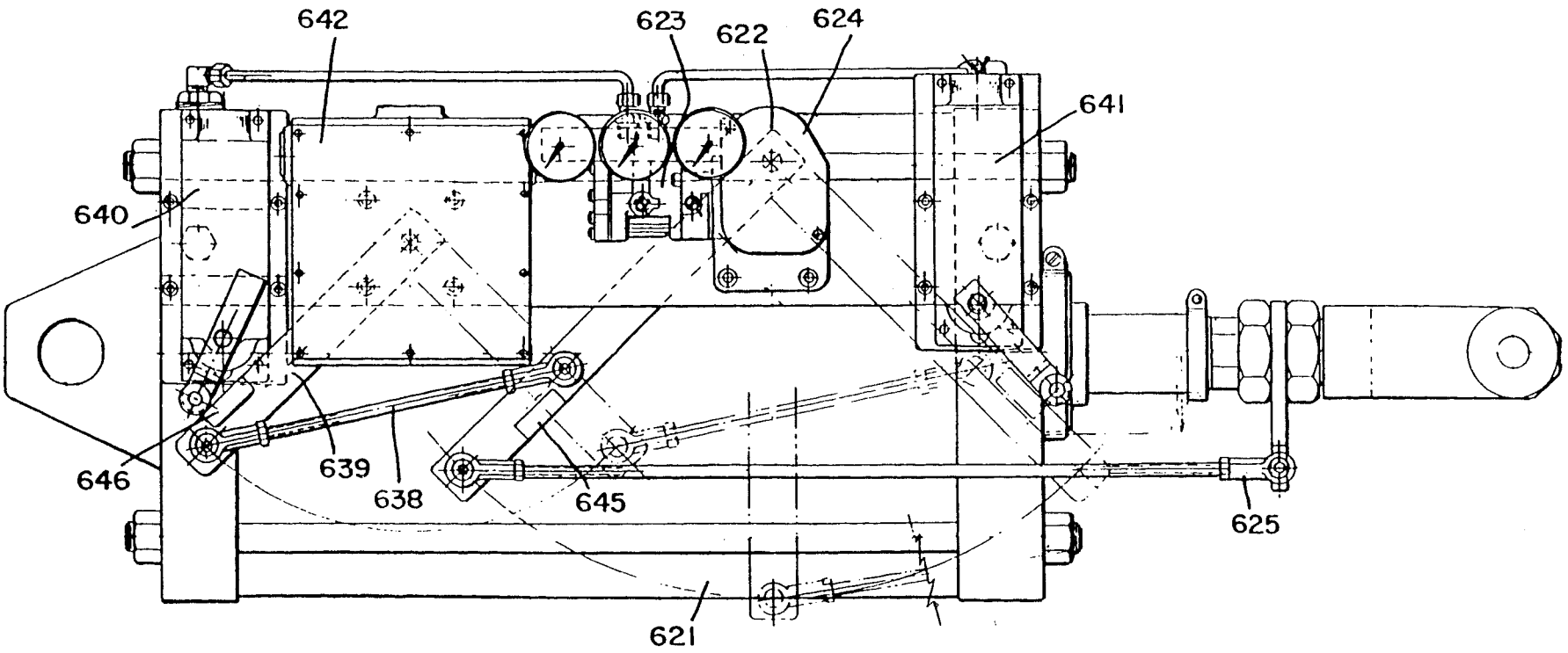
FIG. 15 is a plan view of a fifth position-controlled actuator embodying the principles of the present invention.
Figure 16:
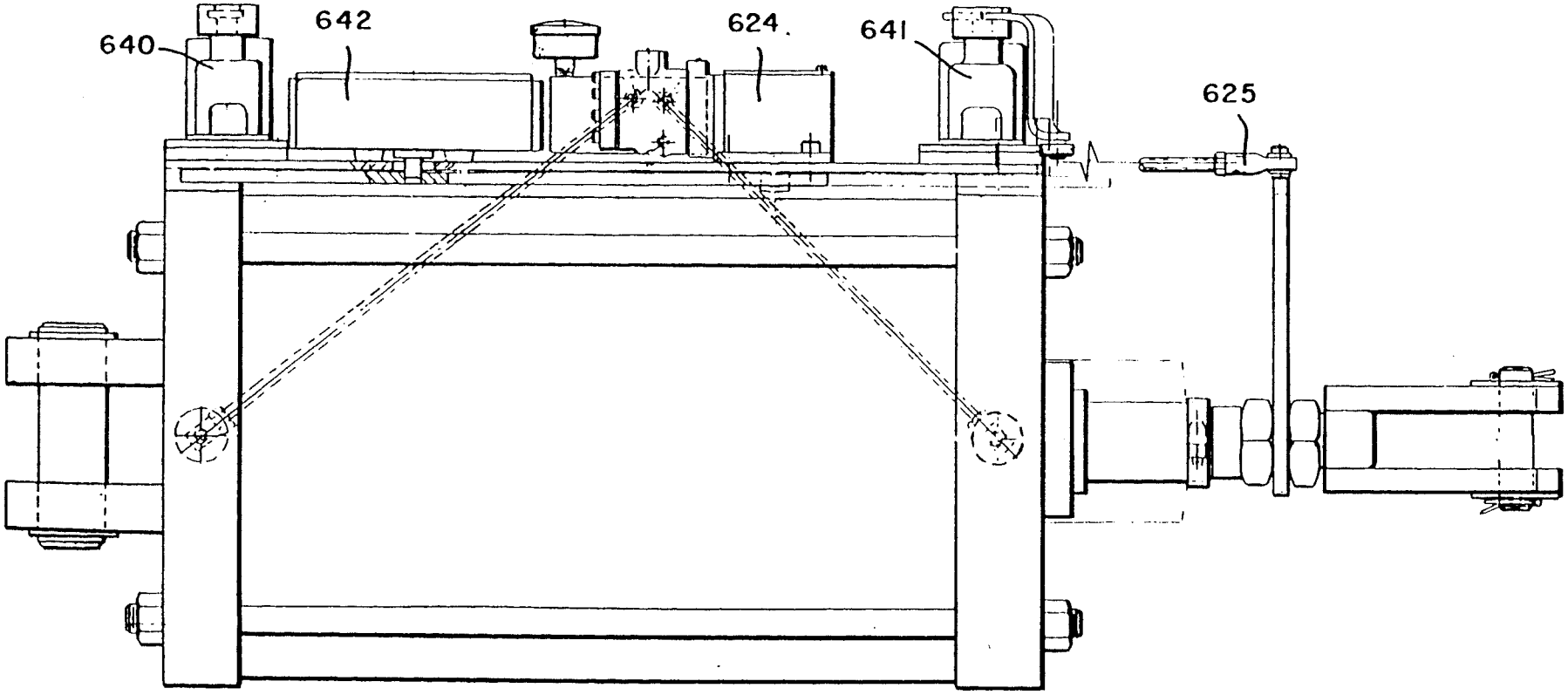
FIG. 16 is a front elevation view of the device shown in FIG. 15.
Figure 17:
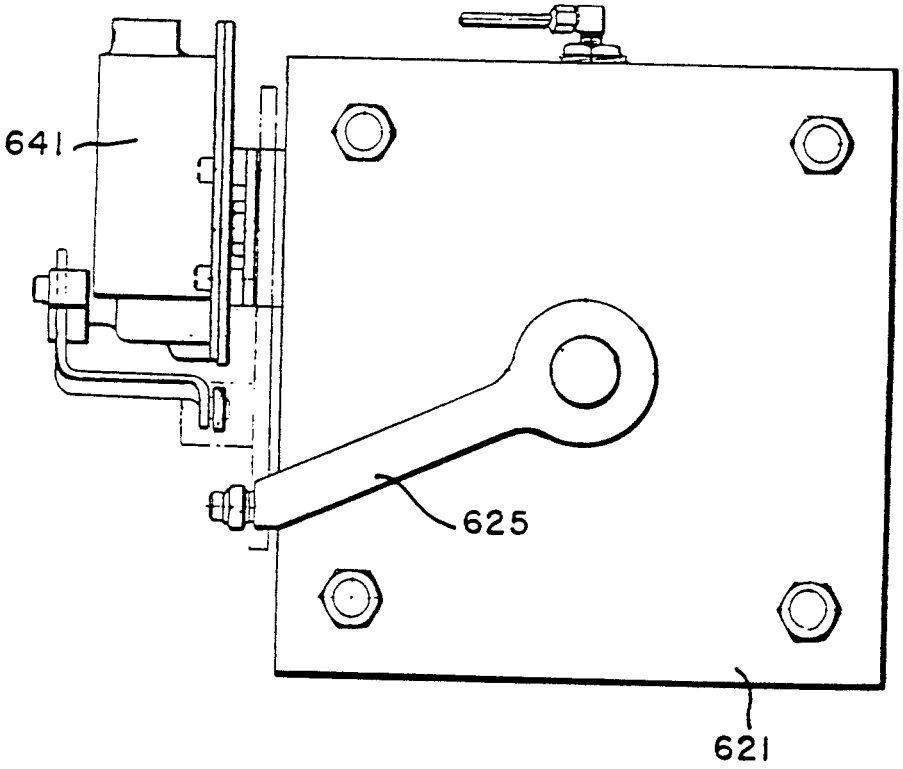
FIG. 17 is a right side view of the device shown in FIG. 15.

FIGS. 15–17 show various views of another typical embodiment of the present invention. In this embodiment, there is an actuator 521, a controller 522, as selector valve 523, a comparator 524 and a feedback link 525. In addition, the crank arm 637 carries a contact plate 645, and crank arm 639 carries a contact plate 646, which, at the extremes of their swings, set off end point sensors 640 and 641 which feed back signal to the main controller 18 of the system indicating that the positioner is in one or the other of its extreme positions. In this embodiment, in addition to the end point sensors, a position sensor 642 is provided which, when connected through crank 639 and link 638 to the crank arm 645, sends a signal back to the main computer indicative of the intermediate position of the actuator system.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. A position-controlled actuator comprising: (a)

a pneumatic linear actuator having a stationary portion which includes a housing and a chamber within the housing and a movable portion, which includes a piston that moves in the chamber and a piston rod which is connected to the piston and extends out of the chamber, (b)

a selector valve which is mounted on the housing and which causes motion of the said movable portion, (c)

a comparator which is mounted on the housing and which controls the action of the selector valve, by means of a pivoted, arm, a pivoted cam mounted on the arm, and a cam follower which engages the selector valve, and (d)

a feedback link which includes a first link arm rigidly mounted to the piston rod and a second link, distinct from the first link, which second link connects the first link arm to the pivoted arm of the comparator, which feedback link continuously signals the comparator concerning the position of the moving portion.

2. A position-controlled actuator as recited in claim 1, wherein the actuator contains seals and the seals are adapted so that the movement of the movable portion avoids oscillation.

3. A position-controlled actuator as recited in claim 1, wherein the actuator contains seals and the seals are adapted so that the movement of the movable portion avoids oscillation because the seals have low static friction.

4. A position-controlled actuator as recited in claim 1, wherein the actuator contains fluorocarbon rubber seals and the seals have low static friction and are adapted so that the movement of the movable portion avoids oscillation.

5. A position-controlled actuator as recited in claim 2, wherein the seals are formed of a fluorocarbon rubber.

6. A position-controlled actuator as recited in claim 2, wherein the seals are formed of VITON-brand fluorocarbon rubber.

* * * * *